US005375389A

United States Patent [19]

Kimura

[11] Patent Number: 5,375,389

[45] Date of Patent: Dec. 27, 1994

[54] JOINT APPARATUS FOR CONSTRUCTION MEMBERS

[75] Inventor: Kazuyoshi Kimura, Yamagata, Japan

[73] Assignee: Shelter Home Co., Ltd., Yamagata, Japan

[21] Appl. No.: 45,181

[22] Filed: Apr. 12, 1993

[51] Int. Cl.[5] ..... E04B 1/26

[52] U.S. Cl. ..... 52/698; 52/646; 403/173

[58] Field of Search ..... 403/171, 173, 176; 52/698, 648.1, 647, 646, 645, 650.2, 651.6

[56] References Cited

U.S. PATENT DOCUMENTS

| | | | |
|---|---|---|---|
| 1,582,587 | 4/1926 | Dunlap | 403/171 |
| 4,863,305 | 9/1989 | Schold | 403/171 |
| 5,022,209 | 6/1991 | Kimura | 403/173 |

FOREIGN PATENT DOCUMENTS

| | | | |
|---|---|---|---|
| 259758 | 6/1949 | Switzerland | 52/650.2 |

*Primary Examiner*—James L. Ridgill, Jr.
*Attorney, Agent, or Firm*—Sandler, Greenblum & Bernstein

[57] ABSTRACT

Joint apparatus for construction members and a building construction are provided with standardized joint members including at least one of a basic joint member including a fitting protrusion of an approximately cross-figured lateral sectional shape, an end plate portion connected at a top or a bottom face of the fitting protrusion, and a projection extending upwardly from the end plate portion for fitting a groove of approximate straight line or cross-figured lateral sectional shape. The joint apparatus is suitable for coupling standardized precut timbers capable of use for construction members so as to form a framework of a building. The joint apparatus for construction members can effectively construct a building in which characteristics of both the conventional frame work method and the built-up wall method are mixed together.

23 Claims, 12 Drawing Sheets

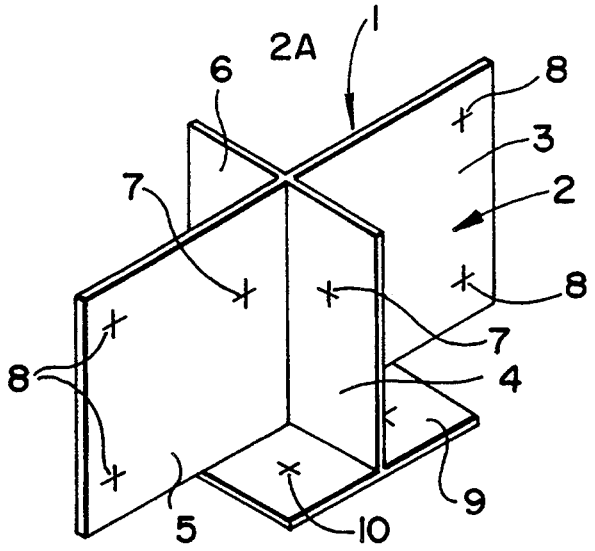
Fig- 1
Fig- 3
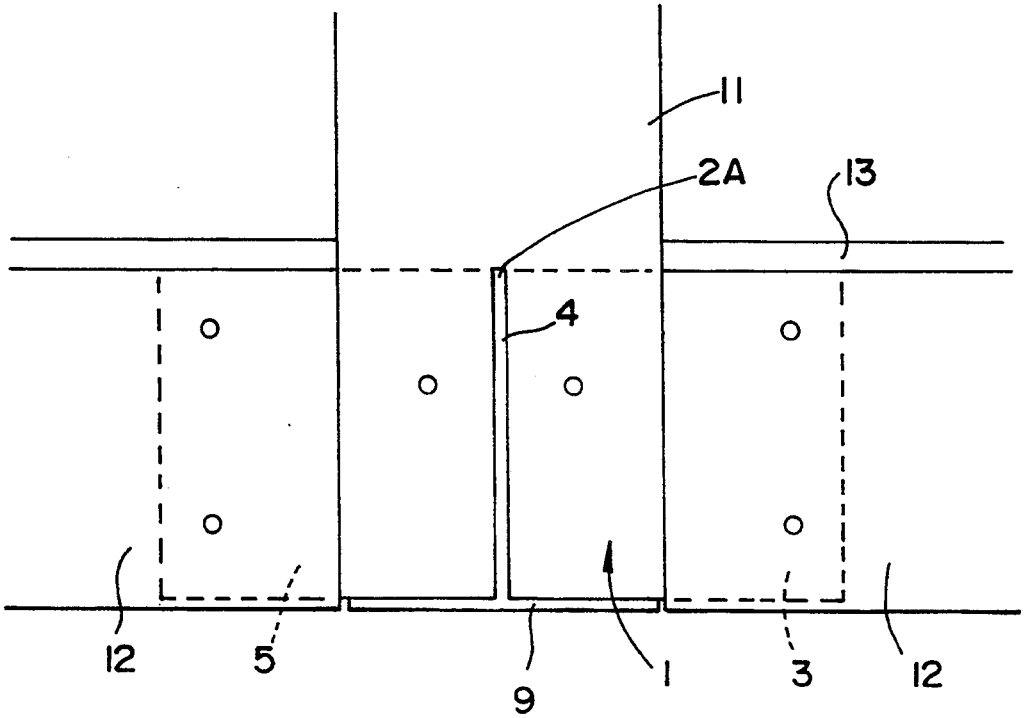

JOINT APPARATUS FOR CONSTRUCTION MEMBERS

Background of the Invention

1. Field of the Invention

The present invention relates to a joint apparatus comprising standardized joint members for coupling standardized precut construction members so as to fabricate a frame work of a building or the like. Further, the present invention relates to a building construction comprising the joint apparatus and the precut members.

2. Discussion of Background Information

Conventional methods for construction of a building, are known, such as the frame work method and the built-up wall method.

The former method is called the "skeleton skin method" or the post & beam work method" and is a construction method using posts and beams as the main members.

The latter method is called "a two-by-four work method" or "a platform frame work method". According to this method, a building is constructed by attaching a wall member, which is formed by clamping a construction plywood or the like to a wall frame assembled by frame members, to a floor. The floor is bound by clamping a construction plywood or a surface member, having a performance comparable or superior to that of a construction plywood, to a floor frame assembled by sleepers.

The differences between these methods will now be described while comparing them with each other. In the first place, the space is constructed by "axes (lines)" in the former method and by "plates (faces)" in the latter method. The structure for imparting a rigidity to a floor surface, a wall surface and the like consists of "angle braces and diagonal braces" in the former method and "construction plywoods" in the latter method. The timbers used are "long timbers having a large section, mainly a square section (through posts)" in the former method and "short timbers having mainly a small section" in the latter method. The working process comprises "continuous fabrication of first floor and second floor axes, platforms and smnall chambers" in order in the former method and "a first floor platform, first floor walls, a second floor platform second floor walls and small chambers (stepwise operation)" in the latter method.

However, these conventional construction methods involve problems, as described below.

Namely, in the conventional frame work method, the space is mainly constructed by axes, and through posts are used. Accordingly, the operation requires much labor and the material cost is increased. Furthermore, since the structure imparting a rigidity to floor faces and wall faces is constructed by angle braces and diagonal braces, the structure becomes complicated and the operation requires time and labor. Especially, since a core wall structure is formed, a foundation should be made and the operation requires much more time and labor.

In the built-up wall method, the space is mainly constructed by faces, and angle braces or diagonal braces need not be used. However, this method is inferior to the frame work method in strength. Furthermore, the operation of assembling wall frames on a floor (operation platform) and raising up the assembled wall frame is necessary and this operation requires much time and labor.

In an operation of constructing a building such as a wooden house, after formation of a foundation, construction members such as timbers are skillfully cut and notched and they are skillfully assembled and coupled according to structure dynamics, and the main coupling portions of the construction members are secured by bolts or the like. In the conventional methods, however, a high degree of technique and skill are required for coupling the construction members, the operation efficiency is low, economical utilization of construction members is poor and the construction term is long. As a result, construction costs are increased.

In recently developed prefabricated buildings, the above-mentioned economical problems are tentatively solved by mass production, but the durability and strength, especially that of the coupled portions, are poor and diversity is insufficient. Furthermore, a prefabricated building becomes wretched with the lapse of time after construction and even if the prefabricated building is used for many years, calmness or massiveness is not imparted to the building.

Under this background, research has been performed by the present invention on coupling of construction members as described above, and, as the result, a joint for construction members, has been developed which is much simpler than the conventional combination of an iron plate and bolts and nuts, that is, the simplest coupling means heretofore adopted, and is superior in the strength to the utilization of wood cutting and notching means.

This joint is disclosed in U.S. Pat. No. 5,022,209.

This joint comprises a basic joint proper having a cubic or trapezoidal shape and a plate member extending outwardly from a surface of the basic joint proper in a plane substantially orthogonal to the surface, which is welded and secured to the basic joint proper, and a hole is formed through the plate member so that a fixing member such as a bolt can pass through this hole. According to this proposal, a variety of joint members can be obtained by combining the basic joint proper and the plate member while changing the shapes, numbers and directions thereof.

However, the basic joint propers that a have several problems including weight of the joint is considerably increased, the amount of material is increased and consequently the joint is disadvantageous from the economic viewpoint. Moreover, because weight of the joint is increased, the handling of the joint and the coupling operation of the construction members are difficult.

The man-hours for preparing the joint are increased and the production efficiency is lowered since the joint has many portions to be welded.

Further, a dimensional error is liable to occur since the basic joint proper is positioned between the construction members such as posts, the beams or the post and the beam. Therefore, some clearances between the construction members may be in error.

Conventionally, various kinds of joints for construction members have been proposed in addition to the joint mentioned above. However, none of these joints are suitable for a large sectional wooden building, such as architectures recently developing for a commercial use, e.g., an apartment building, a store building or an office building having three, four or five stories. Accordingly, most commercial architecture is constructed by means of a heavy steel member construction.

A building using heavy steel construction is disadvantageous from the economical viewpoint, and calmness or massiveness is not imparted to the building.

SUMMARY OF THE INVENTION

It is an object of the present invention to provide a joint apparatus for construction members which can effectively construct a building in which features of both of the conventional frame work method and the built-up wall method are selectively combined.

Another object of the present invention is to provide a joint apparatus for construction members which can reduce the dimensional error between posts, beams or the post and beam while reducing the weight of the joint apparatus, the quantity of the material and the construction cost, and improving the production efficiency of the joint apparatus.

A further object of the present invention is to provide a joint apparatus for construction especially suitable for a heavy sectional wooden building, such as a commercial architecture having three, four or five stories.

Still a further object of the present invention is to provide a building construction comprising the joint apparatus.

In accordance with the present invention, for attaining the foregoing objects, there is provided a joint apparatus for construction members adopted to couple with an end portion of at least one of construction members by means of clamping means wherein;

The construction member comprises at least one of a longitudinal construction member and a lateral construction members, both of which are made of timber. The longitudinal construction members comprising at least one of a first longitudinal construction member having a first groove of an approximate cross-figured lateral sectional shape formed at an end portion of the first longitudinal construction member and a second longitudinal construction member having a second groove of an approximate straight line-figured lateral sectional shape at an end portion of the second longitudinal construction member and a third longitudinal construction member having a third groove of an approximate cross-figured lateral sectional shape formed at an end portion of the third longitudinal construction member and the lateral construction member having a fourth groove of an approximate straight line-figured lateral sectional shape at an end portion of the lateral construction member and the clamping means comprises first to fourth clamping means comprising bolt-nut assemblies, the joint apparatus comprising;

a basic joint member and at least one member selected from a first application joint member, a second application joint member and a third application joint member, the basic joint member comprising first to fourth connecting plate portions defining a first fitting protrusion having an approximate cross-figured lateral sectional shape to be fitted with the corresponding first groove of the first longitudinal construction member and also with the corresponding fourth groove of the lateral construction member at at least an end portion of the first to fourth connecting plate portions, the basic joint member including at least a pair of the connecting plate portions opposed to each other, including first to fourth connecting plate portions, first insertion holes through which the first clamping means penetrate for coupling the connecting plate with the end portion of the first longitudinal construction member, so that the first fitting protrusion is fitted with the corresponding first groove of the first longitudinal construction member, and second insertion holes through which the second clamping means penetrate for coupling the connecting plate with the end portion of the lateral construction member so that the ends of the pair of connecting plate portions are fitted with the fourth groove of the lateral construction members respectively, the first application joint member comprising an end plate portion fixed to at least one of the top and bottom end faces of the first to fourth connecting plate portions of the basic joint member and extending in a lateral direction so as to receive the end portion of one of the first to third longitudinal construction members, the second application joint member comprising a fifth connecting plate portion fixed to an upper face of the first application joint member, the fifth connecting plate portion upwardly extending in parallel with a pair of the connecting plate portions opposed each other of the first to fourth connecting plate portions and having third insertion holes through which the third clamping means penetrate for coupling the fifth connecting plate portion with the end portion of the second longitudinal construction member so that the fifth connecting plate portion is fitted with the corresponding second groove of the second longitudinal construction member, and the third application joint member comprising the first application joint member and the sixth to ninth connecting plate portions defining a second fitting protrusion having an approximate cross-figured lateral sectional shape to be fitted with the corresponding third groove of the third longitudinal construction member, the sixth to ninth connecting plate portions being fixed to the upper face of the first application joint member and upwardly extending in parallel with the first to fourth connecting plate portions respectively, the third application joint member being formed, in at least a pair of the connecting plate portions opposed to each other of the sixth to ninth connecting plate portions, fourth insertion holes through which the fourth clamping means penetrate for coupling the end portion of the third longitudinal construction member so that ends of the pair of connecting plate portions of the sixth to ninth connecting plate portions are fitted with the third grooves of the third longitudinal construction members.

According to the present invention, for example, a post as the longitudinal construction member and a groundsills as the lateral construction member are set, respectively, to the joint apparatus so that the first fitting protrusion of the basic joint member is fitted to the corresponding first groove of the approximate cross-figured lateral sectional shape formed at the end portion of the post as the longitudinal construction member and the end portions of the first and third connecting plate portions are fitted, respectively, to the corresponding first grooves of the approximate straight line-figured lateral sectional shapes formed at the end portions of the groundsills, and clamped by using clamping means through corresponding insertion holes.

In this case, the end face of the post is received by the end plate portion of the first application joint apparatus. The end faces of the groundsills are received by the side faces of the posts, and accordingly, the side faces of the post are in closely contact with the end faces of the groundsills.

Further, for example, the posts and the beams are set, respectively, to the joint apparatus so that the first fitting protrusion of the basic joint member and the second fitting protrusion of the third application joint member are fitted to the corresponding first and third grooves of the approximate cross-figured lateral sectional shapes formed, respectively, at the end portions of the upper and lower posts as first and third longitudinal construction members, and the end portions of the first and third connecting plate portions are fitted to the corresponding fourth grooves of the approximate straight line-figured lateral sectional shapes formed, respectively, at the end portions of the beams, and clamped by using clamping means through corresponding insertion holes.

In this case, the end faces of the upper and lower posts are received by the end plate portion, respectively. Further, the end faces of the beams are received by the side faces of the post. Accordingly, the side faces of the lower post are in closely contact with the end faces of the beams and the end faces of the beams are received by the end plate portion.

For coupling an upper post as a second longitudinal construction member, the second application joint member is also used.

Since a joint member having a fitting protrusion of a cross-figured lateral sectional shape is used as the basic joint member, the weight of the joint apparatus and the quantity of the material can be reduced, and therefore, the construction cost can be reduced. Further, because the weight of the joint apparatus is reduced, the handling of the joint can be simplified and the operation of connecting the construction members is facilitated.

The man-hours for preparing the joint is reduced and the production efficiency can be improved since the joint has only a few portions to be welded.

A dimension error can be avoided since the construction members, such as the posts, the beams, the post and the beams and the like, are in closely contact with each other.

Since a joint member having a fitting protrusion of a cross-figured lateral sectional shape is used as the basic joint member, longitudinal and lateral construction members, namely, longitudinal posts, lateral beams and the like, can be variably clamped to the basic joint member. Further, the clamping of the construction members can be accomplished irrespective of the direction thereof. Therefore, the member of items of the joint can be reduced, the production efficiency can be improved and the construction cost can be reduced.

It is preferable that the basic joint member may comprise a single plate member integrally defining two connecting plate portions opposed each other and two plate members which define, respectively, two connecting plate portions opposed each other and are fixed to each side surface of the single plate member at each end portion of the two plate members. The two plate members may extend orthogonally to the respective side surfaces of the single plate member.

The end plate portion of the first application joint member may be connected to the bottom end faces of the first to fourth connecting plate portions of the basic joint member at an upper face of the end plate, and may extend orthogonally to the first to fourth connecting plate portions.

The end plate portion has approximately the same size as the lateral section of the end portion of the first longitudinal construction member.

The end plate portions of the first application joint member may be connected to the bottom end face of an outer end portions of at least one of the connecting plate portions of the basic joint member and extend approximately orthogonally to the connecting plate portion.

The end plate portion of the first application joint member may be connected to the top end faces of the first to fourth connecting plate portions of the first fitting protrusion at lower face of the end plate, and extend orthogonally to the first to fourth connecting plate portions.

The end plate portion may have approximately the same size as the lateral section of the first longitudinal construction member.

The fifth insertion holes may be formed in the end plate portion of the first application joint member through which anchor bolt means penetrate to couple the end plate portion with a foundation.

The second fitting protrusion may comprise a single plate member integrally defining two connecting plate portions opposed each other and two plate members defining, respectively, two connecting plate portions opposed each other and being fixed to each side surface of the single plate member at each end portion of the two plate members, the two plate members extending orthogonally to the respective side surface of the single plate member.

In accordance with the present invention, there is also provided a building construction constructed by coupling the joint apparatus for construction members, in combination with clamping means, which comprises the basic joint member combined with at least one member selected from the first application joint member, the second application joint member and the third application joint member, with at least one member selected from the first longitudinal construction member, the second longitudinal construction member, the third longitudinal construction member and the lateral construction members.

Embodiments according to the present invention will now be described in detail with reference to the accompanying drawings. The structure and features of the present invention shall be fully understood by the embodiments. However, the present invention is not limited to the embodiments and can be modified within the range of the claims.

BRIEF DESCRIPTION OF THE DRAWINGS

FIG. 1 is a perspective view illustrating one embodiment of a joint apparatus for construction members according to the present invention.

FIG. 3 is a front view showing an example in which the joint apparatus in FIG. 1 is used.

DETAILED DESCRIPTION OF THE PREFERRED EMBODIMENTS

Figure 2A:
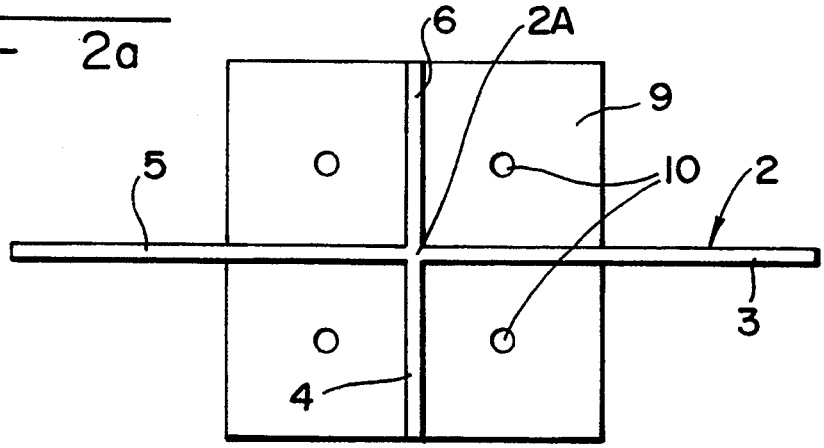
FIGS. 2A, 2B and 2C show a plan view, a front view and a side view of the joint apparatus in FIG. 1, respectively.
Figure 2B:
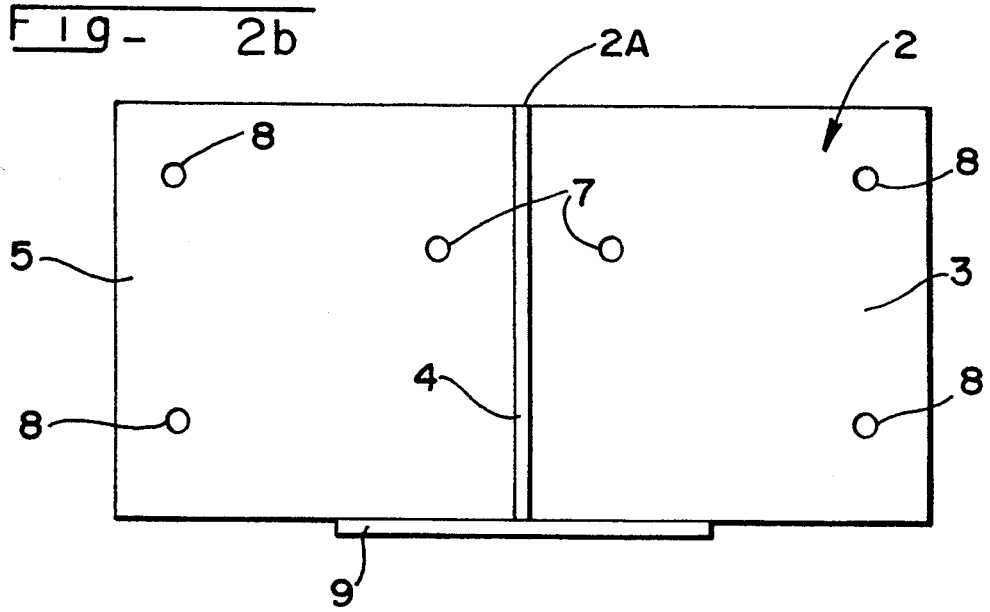
Figure 2C:
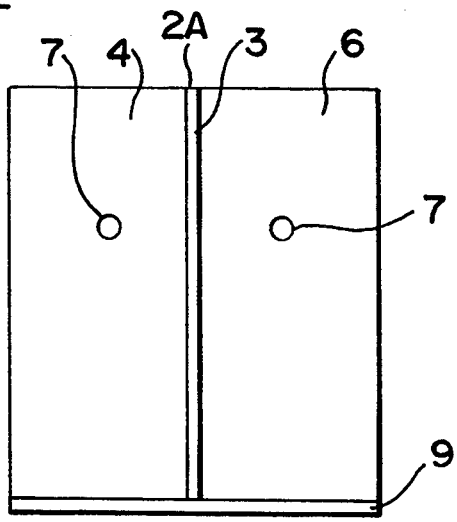
Figure 4A:
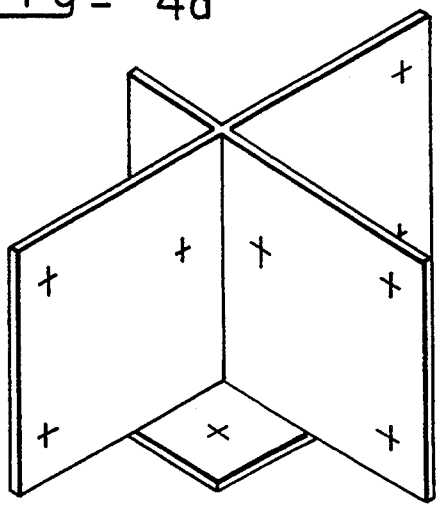
FIGS. 4A through 4E are perspective views showing modifications of the joint apparatus shown in FIG. 1.
Figure 4B:
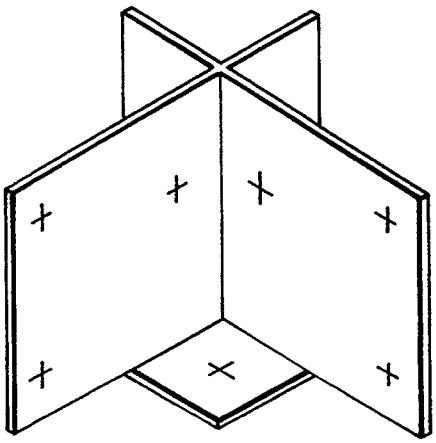
Figure 4C:
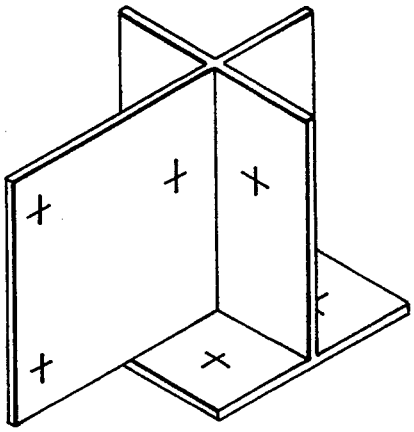
Figure 4D:
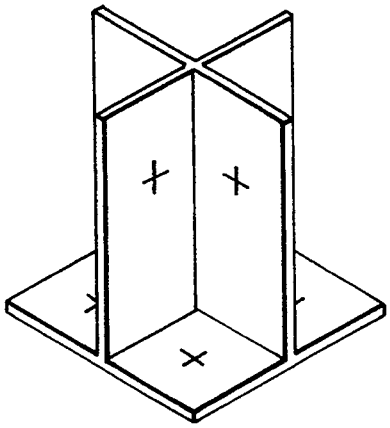
Figure 4E:
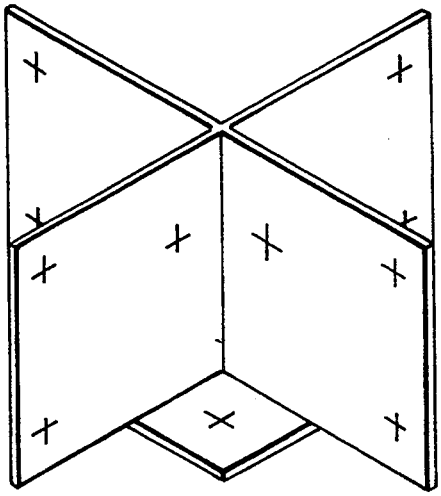

As one embodiment of a joint apparatus (to be referred as a connector hereinafter) according to the present invention, a pedestal connector 1 for coupling a groundsill with a post or the like is shown in FIGS. 1 to 3.

Namely, a pedestal fitting 2 acting as a basic joint member comprises a first fitting protrusion 2A having an approximate cross-figured lateral sectional shape which is fitted to a corresponding groove having an approximate cross-figured lateral sectional shape formed in an end portion of a post 11.

The first fitting protrusion 2A comprises first to forth connecting plate portions 3 to 6 orthogonally fixed to each other at one end of each connecting plate portion and extending in a longitudinal direction.

The lateral total length of the first and third connecting plate portions 3 and 5 opposed to each other is longer than the lateral total length of the second and fourth connecting plate portions 4 and 6 opposed to each other.

In this case, for instance, the basic joint member is formed in such a manner that two plate members defining the second and fourth connecting plate portions 4 and 6, respectively, are fixed by welding to a single plate member integrally defining the first connecting plate portion 3 and the third connecting plate portion 5.

Insertion holes 7 for insertion of bolts of bolt-nut assemblies as the clamping means for coupling post 11 are formed in the second and fourth connecting plate portions 4 and 6. Insertion holes 7 for insertion of bolts of bolt-nut assemblies as the clamping means for coupling the post 11 and insertion holes 8 for insertion of bolts for coupling groundsills 12 acting as lateral construction members are formed in the first and third connecting plate portions 3 and 5 which are opposed to each other.

A first application joint member, that is, an end plate portion 9 as a clamping portion to a foundation or the like in the present embodiment, extends orthogonally to the respective surfaces of the connecting plate portions 3 through 6, and is connected by welding to the bottom end face of the first fitting protrusion 2A at an upper face thereof.

Insertion holes 10 for insertion of anchor bolts embedded in the foundation or the like are formed in the end plate portion 9.

the size of the end plate portion 9 is same as the lateral section of the end portion of the post 11.

As shown in FIG. 3, clamping of the post 11 and the groundsills 12 to the pedestal connector 1 is accomplished, for example, by setting the post 11 and the groundsills 12 at the pedestal connector 1, respectively, so that the first fitting protrusion 2A is fitted to the corresponding groove of the approximate cross-figured lateral sectional shape formed in advance by cutting at the end portion of the post 11, and end portions of the first and third connecting plate portions 3 and 5 are fitted, respectively, to corresponding grooves, each of which has an approximate straight line-figured lateral sectional shape, formed in advance by cutting at the end portions of the groundsills 12, and clamping them by using bolts and nuts.

In this case, the lower end face of the post 11 is received by the end plate portion 9. Further, the end faces of the groundsills 12 are received by the side faces of the post 11 and the side faces of the post 11 are in closely contact with the end faces of the groundsills 12.

Numeral 13 in FIG. 3 shows construction plywood to be fixed to the top end faces of the groundsills 12.

A laminated wood is used for the post 11. The laminated wood is formed by combining wooden plates so that the fabric directions of the wooden plates are parallel to the longitudinal direction of the post 11 and adhering them with synthetic resin adhesive.

Modifications of the pedestal connector 1 are shown in FIGS. 4A through 4E.

The pedestal connector in each view comprises the basic joint member combined with the first application joint member, namely, the pedestal fitting combined with the end plate portion. The lateral length of the first to fourth connecting plate portions in the pedestal fitting can be changed to various sizes.

Figure 5:
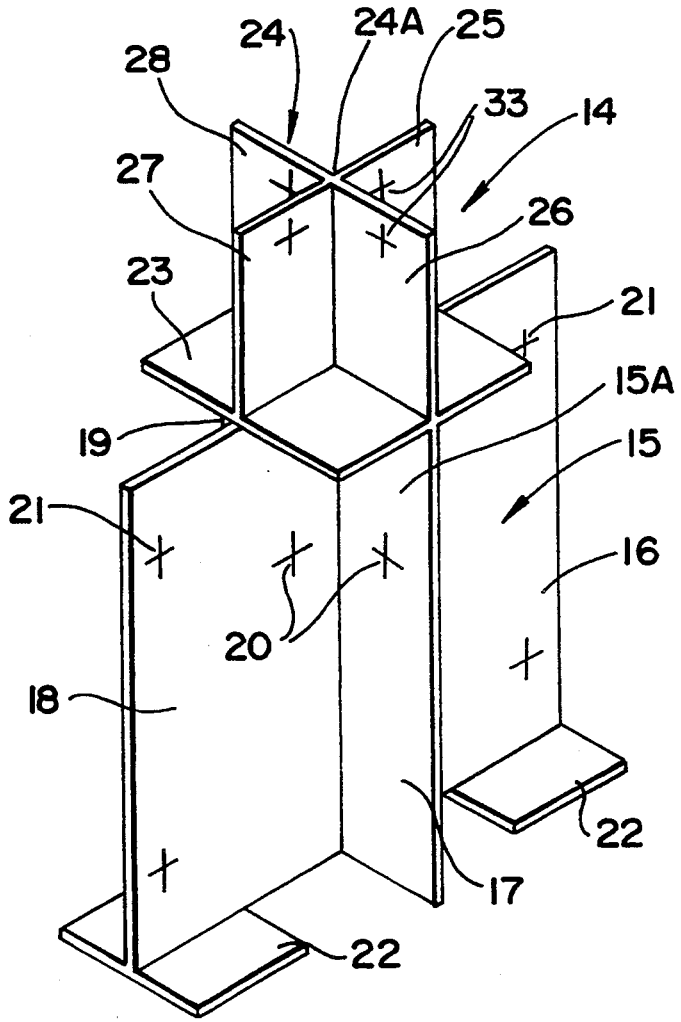
FIG. 5 is a perspective view illustrating another embodiment of the joint apparatus for construction members according to the present invention.
Figure 6A:
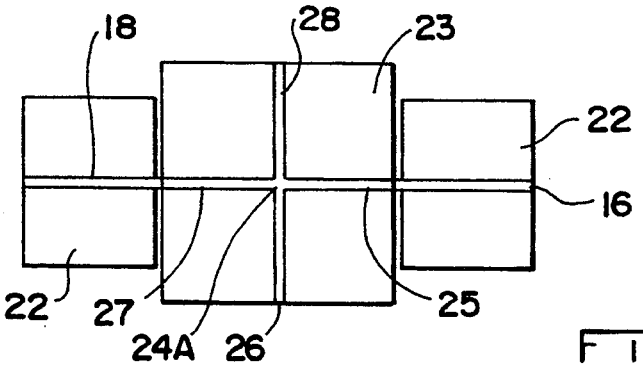
FIGS. 6A, 6B and 6C show a plan view, a front view and a side view of the joint apparatus in FIG. 5, respectively.
Figure 6B:
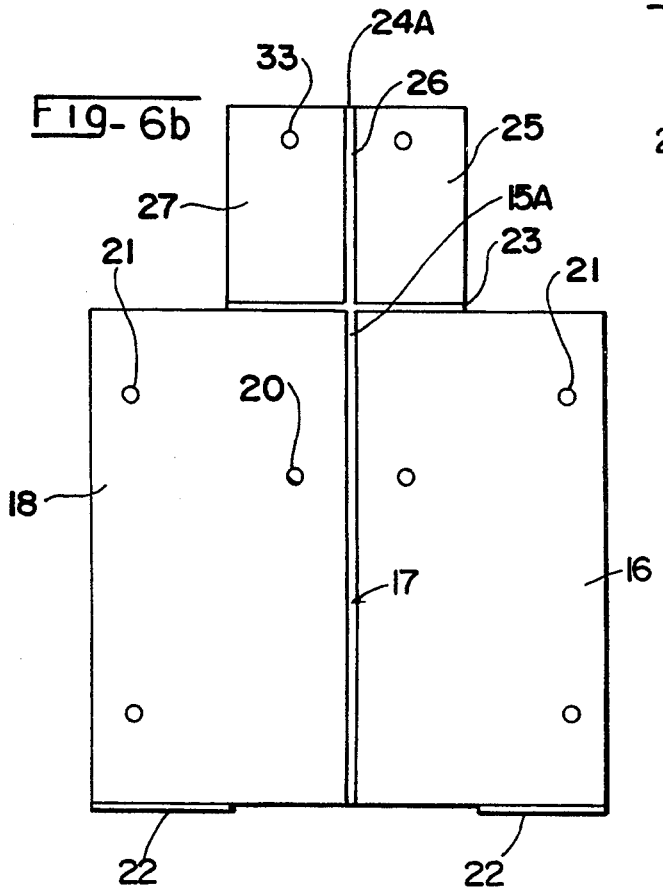
Figure 6C:
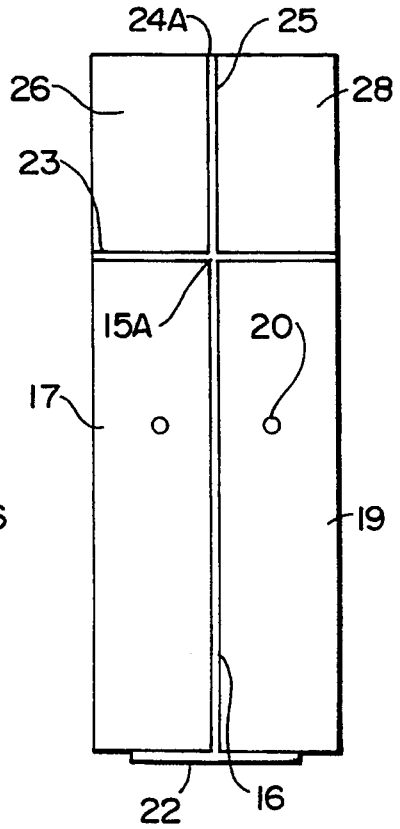
Figure 7:
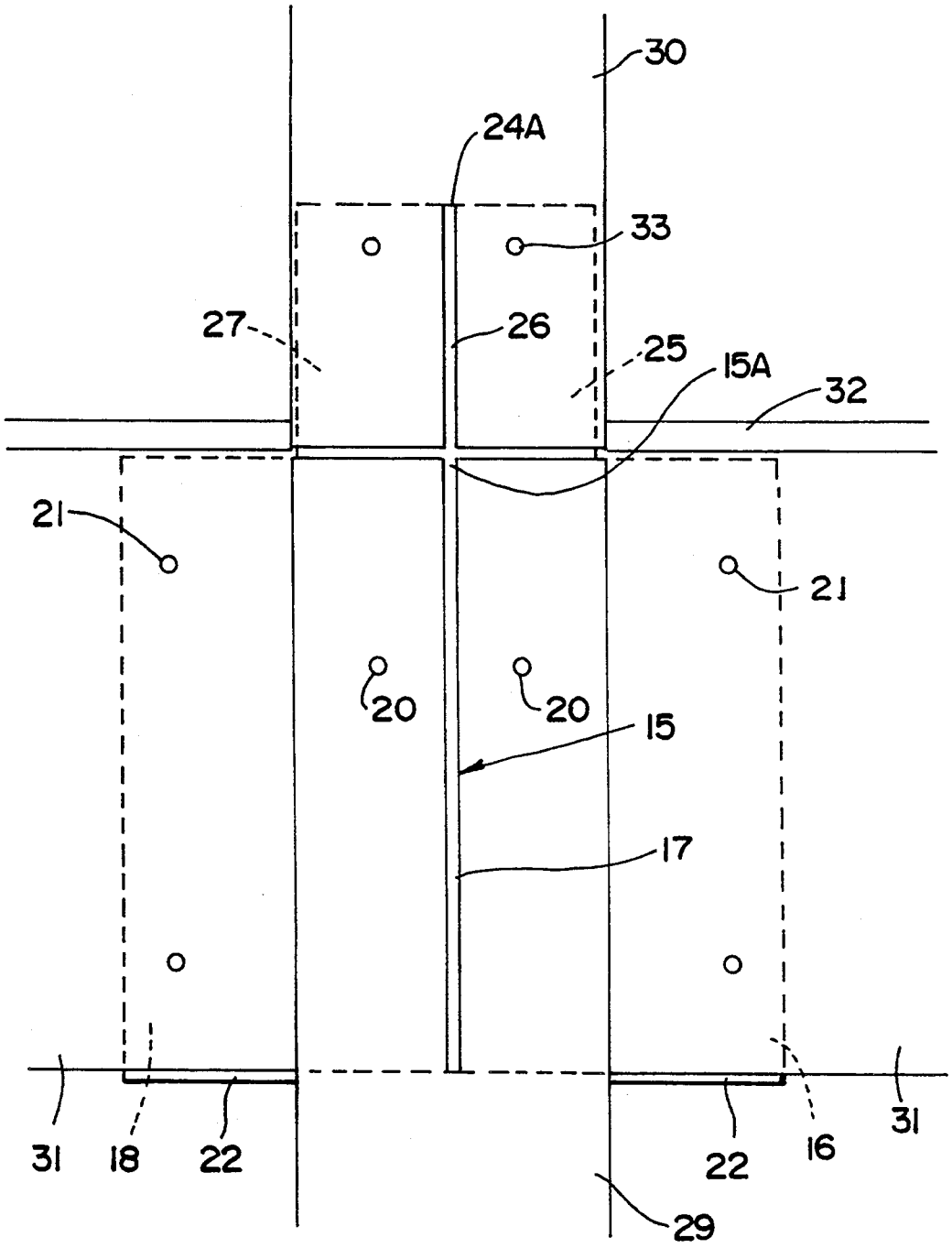
FIG. 7 is a front view showing an example in which the joint apparatus in FIG. 5 is used.

In another embodiment of the beam-girth connector 14, according to the present invention, shown in FIGS. 5 to 7, a beam-girth connector 14 couples upper and lower posts with each other, girths as lateral construction members with each other and in addition, floor beams with each other.

As in the pedestal fitting in the aforementioned embodiment, a first post-connecting fitting 15, acting as a basic joint member, comprises a first fitting protrusion 15A. Insertion holes 20 for insertion of bols as clamping means, for coupling a post 29 are formed in first to fourth connecting plate portions 16 to 19 defining the first fitting protrusion 15A. Insertion holes 21, for insertion of bolts for coupling beams 31 as lateral construction members, are formed in the first and third connecting plate portions 16 and 18.

First application joint members, namely, end plate portions 22, receiving the beams 31 in this embodiment, extend orthogonally to the respective surfaces of the first and third connecting plate portions 16 and 18, and are fixed by welding to the bottom end faces of the lower side of end portions of the respective connecting plate portions 16 and 18.

Additionally, the space between both of the end plate portions 22 is approximately the same dimension as the width of the lateral section of the post 29.

Further, an end plate portion 23 receiving a bottom end face of an upper post 30 and a top end face of the lower post 29, as a first application joint member, extends orthogonally to the respective surfaces of the connecting plate portions 16 to 19 and is fixed to the top end face of the first fitting protrusion 15A of the first post-connecting fitting 15.

The dimension of the end plate portion 23 is approximately the same as the lateral section of the end portion of the post 30.

A second post-connecting fitting 24 for connecting the upper post 30, as a third application joint member, comprises a second fitting protrusion 24A having an approximate cross-figured lateral sectional shape. The second fitting protrusion 24A comprises sixth to ninth connecting plate portions 25 to 28, orthogonally fixed to each other at each end portion thereof, and extending in parallel with the connecting plate portions 16–19.

A bottom end face of the second fitting protrusion 24A is fixed by welding to the top end face of the end plate portion 23.

The lateral length of the connecting plate portions 25 to 28 is identical with each other and is approximately the same as the width of the lateral section of of post 30.

In this case, for instance the second fitting protrusion 24A is formed in such a manner the two plate members defining the seventh and ninth connecting plate portions 26 and 28, respectively opposed to each other, are fixed by welding to each side of a single plate member which integrally defines the sixth connecting plate portion 25 and the eigth connecting plate portion 27 opposed to each other.

Insertion holes 33 for insertion of bolts as clamping means for coupling the post 30, are formed in the sixth to ninth connecting plate portions of the second fitting protrusion 24A.

As shown in FIG. 7, clamping of the posts 29 and 30, and the beams 31 to the beam-girth connector 14 is accomplished, for example, by setting the posts 29 and 30, and the beams 31 at the beam-girth connector 14, respectively, so that the first fitting protrusion 15A of the first post-connecting fitting 15 and the second fitting protrusion 24A of the second post-connecting fitting 24 are fitted, respectively, to corresponding grooves, each of which has an approximate cross-figured lateral sectional shape, formed in advnace by cutting at the end portions of the lower and upper post 29 and 30. The end portions of the first and third connecting plate portions 16 and 18 are fitted, respectively, to corresponding grooves, each of which as an approximate straight line-figured lateral sectional shape, formed in advance by cutting at the end portions of the beams 31, and clamping them by using bolts and nuts.

In this case, the end faces of the posts 29 and 30 are received by the end plate portion 23, respectively. Further, the end faces of the beams 31 are received by the side faces of the lower post 29, the side faces of the lowr post 29 are in close contact with the end faces of the beams 31, and the end faces of the beams 31 are received by the end plate portions 22, respectively.

Numeral 32 in FIG. 7 shows construction plywood to be fixed to the top end portions of the beam 31.

A laminated wood is used for the posts 29 and 30, and for the beams 31.

Figure 8A:
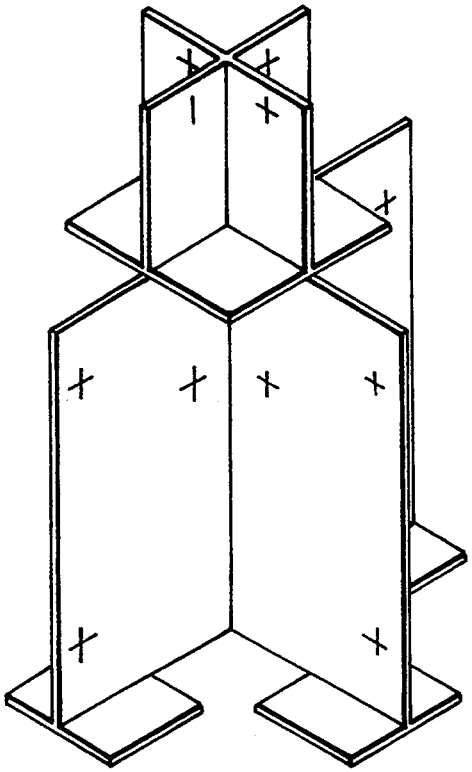
FIGS. 8A through 8C are perspective views showing modifications of the joint apparatus in FIG. 5.
Figure 8B:
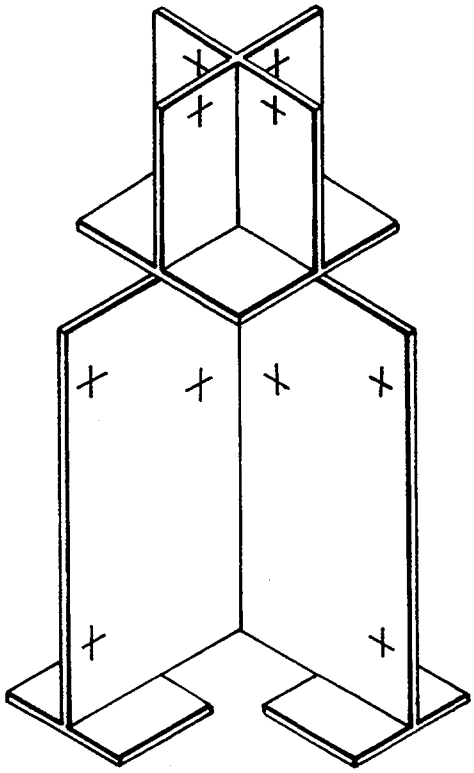
Figure 8C:
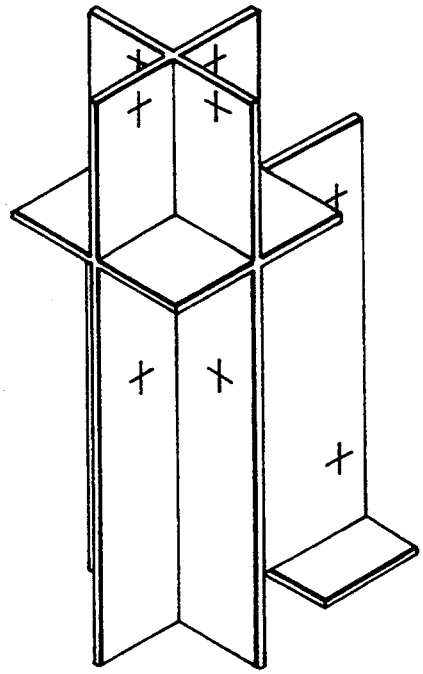

Modifications of the beam-girth connector 14 are shown in FIGS. 8A to 8C.

The beam-girth connector in each view comprises the basic joint member combined with the first application joint member and the third application joint member, namely, the first-post connecting fitting, combined with the end plate portions and the second post-connecting fitting. The lateral length of the first to fourth connecting plate portions in the first post-connecting fitting can be changed to various sizes.

Figure 9:
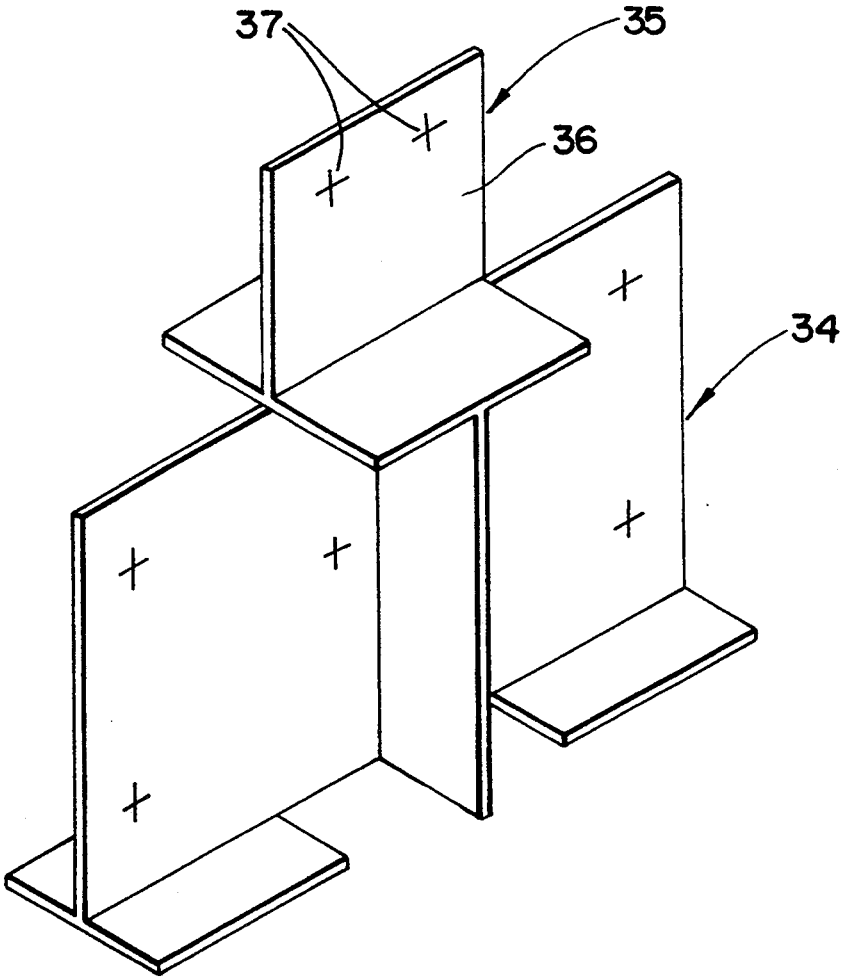
FIG. 9 is a perspective view illustrating a further embodiment of the joint apparatus for construction members according to the present invention.

FIG. 9 shows a further embodiment of the beam-girth connector.

A beam-girth connector 34 in this embodiment has a second post-connecting fitting 35 for connecting an upper post as a second application joint member instead of the third application joint member in the aforementioned embodiment. The second post-connecting fitting 35 comprises a fifth connecting plate portion 36 extending in a longitudinal direction parallel to the opposed connecting plate portion.

Insertion holes 37 for insertion of bolts, as clamping means for coupling a post, are formed in the fifth connecting plate portion 36 so that the fifth connecting plate portion is fitted into the corresponding straight lines-figured lateral sectional shape which is formed at the end portions of the post 30.

Figure 10:
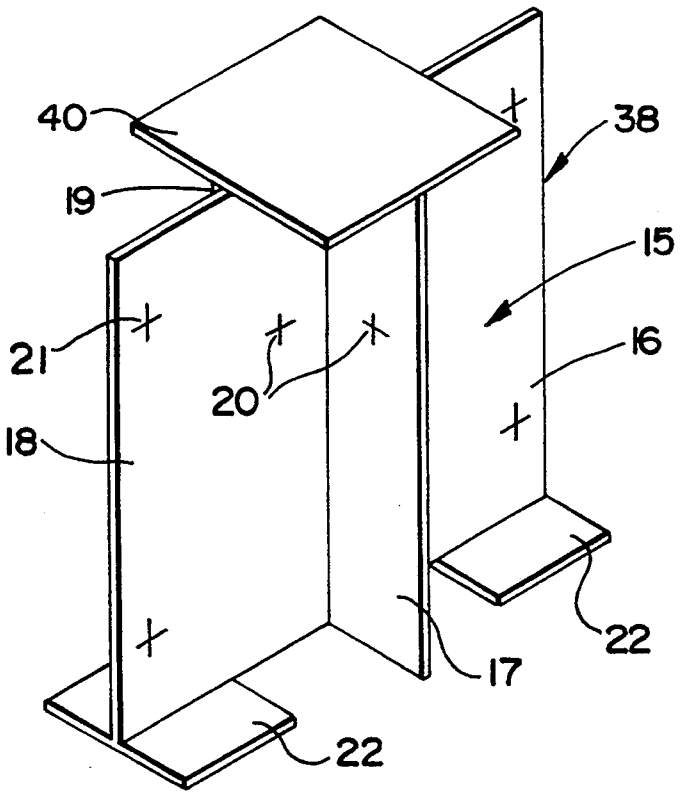
FIG. 10 is a perspective view illustrating a still further embodiment of the joint apparatus for construction members according to the present invention.
Figure 11A:
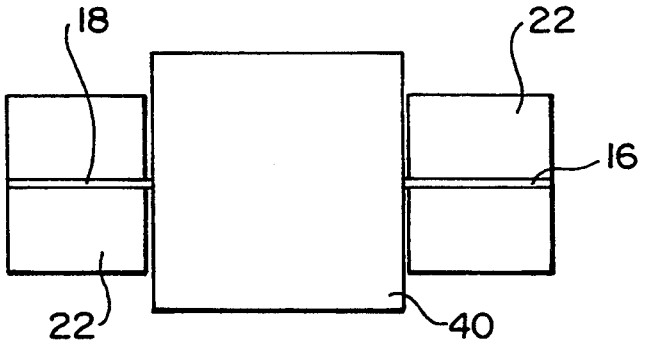
FIGS. 11A, 11B and 11C show a plan view, a front view and a side view of the joint apparatus in FIG. 10, respectively.
Figure 11B:
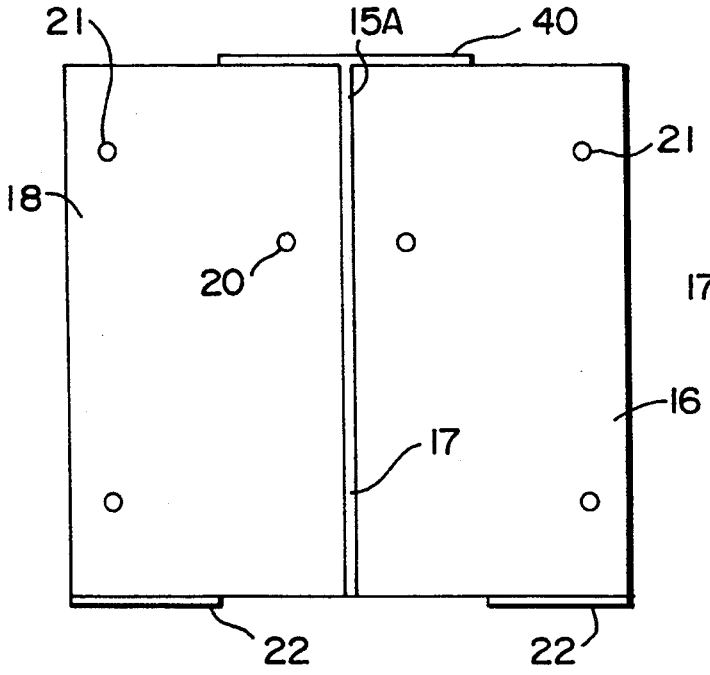
Figure 11C:
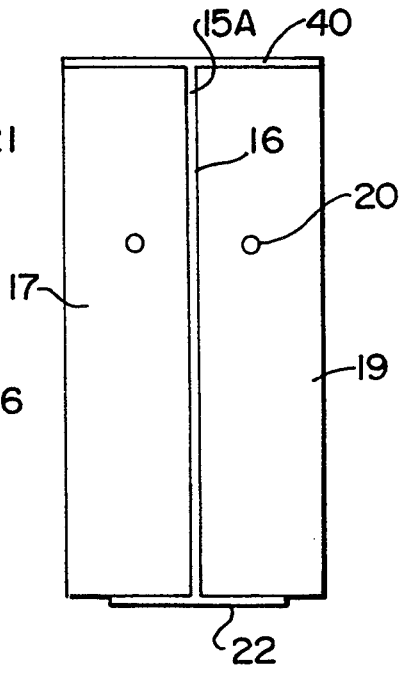
Figure 12:
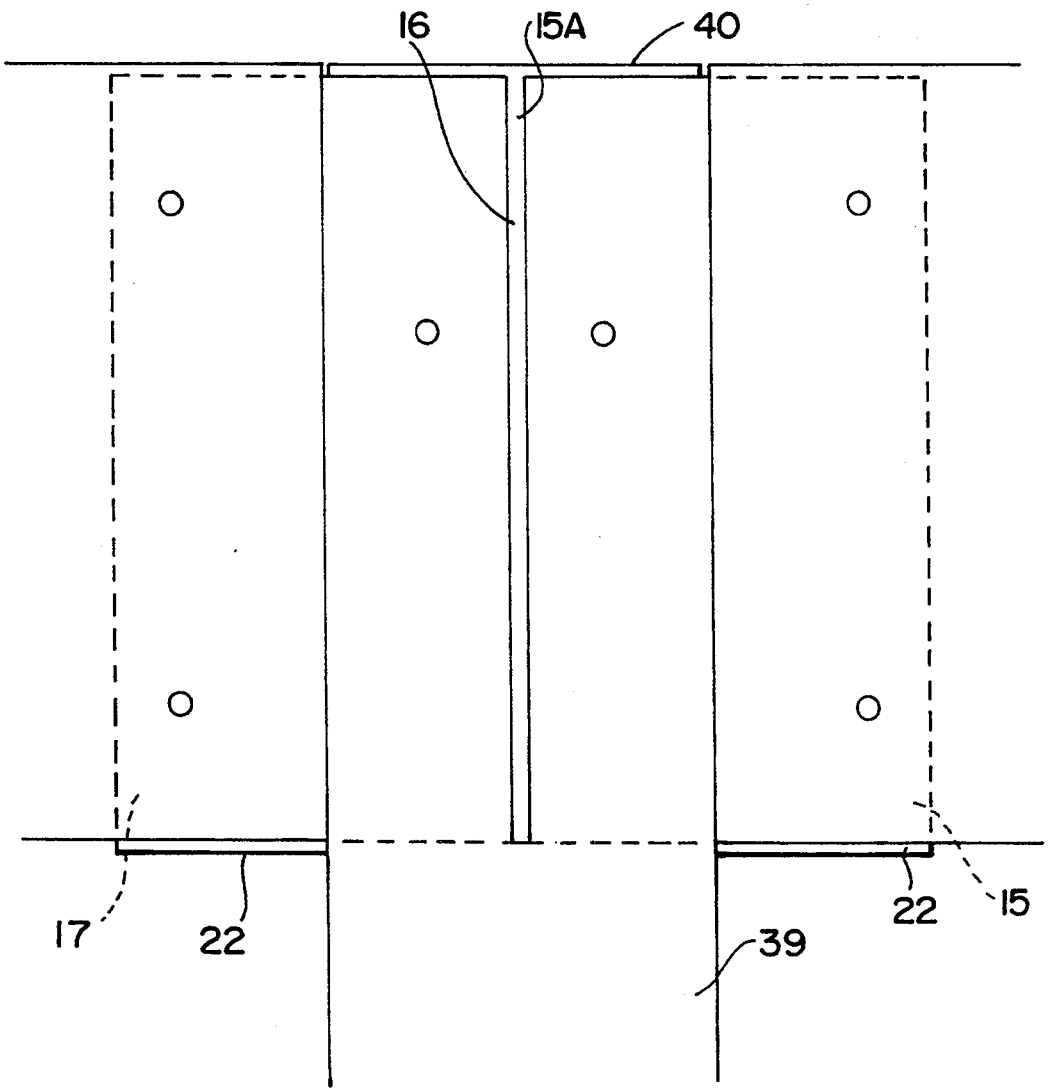
FIG. 12 is a front view showing an example in which the joint apparatus in FIG. 10 is used.
Figure 13A:
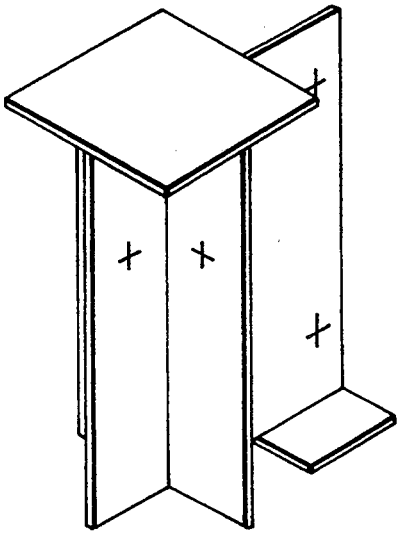
FIGS. 13A through 13D are perspective views showing modifications of the joint apparatus in FIG. 10.
Figure 13B:
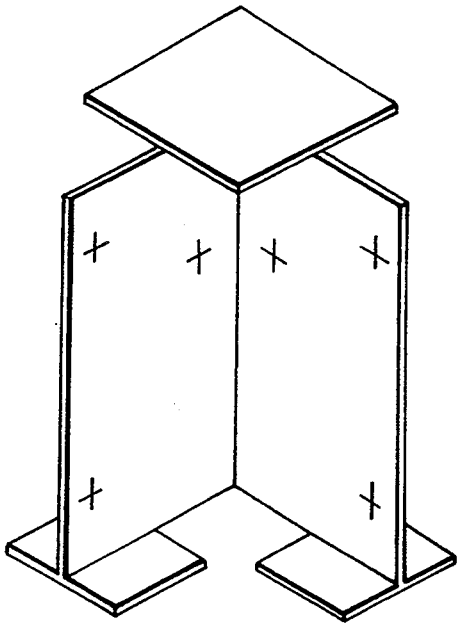
Figure 13C:
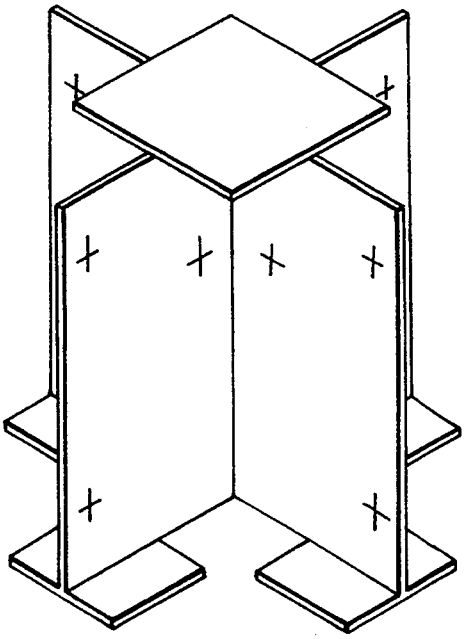
Figure 13D:
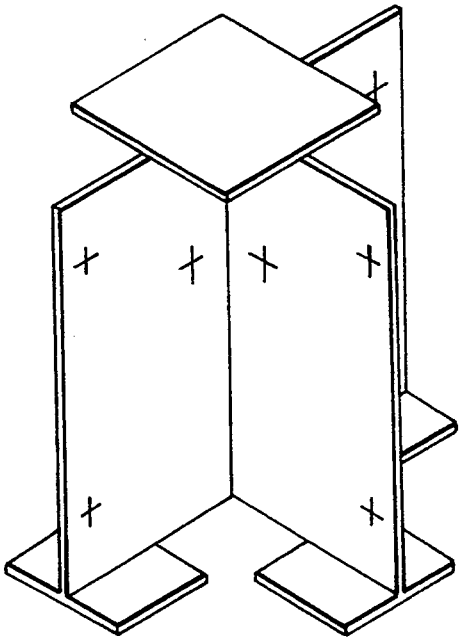

As a still further embodiment of the connector according to the present invention, FIGS. 10 to 12 show a capital connector 38 to be used for a capital.

Namely, in the capital connector 38, an end plate portion 40 receiving the top end portion pf a post 39, as a first application joint member, extends orthogonally to the respective surfaces of the connecting plate portions 16 to 19 and is fixed by welding to the top end face of the fitting protrusion 15A of the first post-connecing fitting 15 in FIG. 5. The end platte portion 40 does not comprise second and third application joint members.

Modifications of the capitall connector are shown in FIGS. 13A to 13D.

The capital connector in each view comprises the basic joint member combined with the first application joint member, namely, the first post-connecting fitting combined with the end plate portions. The lateral length of the first to fourth connecting plate portions can be changed to various sizes.

Incidentally,the thickness of a plate member defining each connector mentioned above, for example, is set to 4.5 mm, however, the thickness can be set to an optimum thickness according to a span of the like.

As is apparent from the description mentioned above, according to the joint apparatus for construction members and the building construction of the present invention, coupling and connection of the construction members can be completed only by a simple operation using clamping means such as bolt clamping. The floor space and height can be freely changed by using minimum standard buildings, and if appropriate joint apparatus are used, the floor space and height can be very easily changed in anticipation of enlargement or remodeling. A variety of houses meeting the demands of users can be constructed by using a small number of standard buildings, similar to the case where various toy blocks differing in the shape are combined. Moreover, since the joint apparatus and the construction members connected by the joint apparatus can be standardized, it is sufficient if all the joint apparatus are prepared in a factory and only the construction members are precut in the factory. Still further, the connection of construction members attained by the joint apparatus is very strong and the strength is much higher than the strength attained in the conventional methods using iron plates, bolts and nuts.

The prominent characteristic features of the joint apparatus of the present invention are as follows.

Since a joint member having a simple cross-figured shape is used as the basic joint member, instead of the conventional joint proper having a cubic or trapezoidal shape, the weight of the joint apparatus and the quantity of the material can be reduced, and therefore, the construction cost can be reduced. Further, as a result that the weight for the joint apparatus is reduced, the handling of the joint can be simplified and the operation of connecting the construction members can be facilitated.

The man-hours for preparing the joint are reduced and the production efficiency can be improved since the joint has only a few portions to be welded.

Further, a dimension error can be avoided since the construction members, such as the posts, the beams, the post and beams, and the like, are in close contact with each other.

Since a joint member having a cross-figure shape is used as the basic joint member, longitudinal and lateral construction members namely, longitudinal posts, lateral beams and the like, can be variably coupoled to the basic joint member and further, the clamping of the construction members can be accomplished irrespective of the directions thereof. Therefore, items of the joint can be reduced, the production efficiency can be improved and the construction cost can be reduced.

Incidentally, according to the present invention, a frame work can be formed at about ⅓ cost in comparison with a heavy steel construction of the same scale, and therefore, the construction cost can be reduced.

Particularly, advantages mentioned below are obtained by the building construction according to the present invention.

Namely, the joint apparatus of the present invention is used for a large span construction and laminated woods are used as the construction members, such as the beams, the posts and the like. Therefore, a warp or a shrinkage of the construction members can be avoided. Further, since the building construction can be divided by large grids, the working operation can be improved. Moreover, the working operation can be standardized and therefore, performed irrespective of the skill of the worker. Accordingly, the building construction according to the present invention has a remarkable effect on the working operation of a heavy section wooden building, such as a commercial architecture (an apartment building, a store building of an office building) of three, four or five stories.

Calmness or massiveness can be imparted to this heavy section wooden building in comparison with the building made of the heavy steel construction.

I claim:

1. A joint apparatus for coupling with an end portion of at least one construction member, comprising:

a basic joint member comprising first through fourth connecting plate portions, said first through fourth connecting plate portions defining a first fitting protrusion comprising a substantially cross-figured lateral sectional shape, each of said first through fourth connecting plate portions including a top surface and a bottom surface, and at least two of said first through fourth connecting plate portions comprising a pair of opposing plate portions including at least one first insertion hole and at least one second insertion hole; and at least one application joint member selected from the group consisting of a first application joint member, a second application joint member and a third application joint member;

said first application joint member comprising at least one end plate portion fixed to at least one of said top and bottom surfaces of said first through fourth connecting plate portions of said basic joint member and extending in a lateral direction;

said second application joint member comprising at least one end plate portion comprising an upper face, said at least one end plate portion being fixed to at least one of said top and bottom surfaces of said first through fourth connecting plate portions of said basic joint member and extending in a lateral direction; and a fifth connecting plate portion fixed to said upper face of said at least one end plate portion, said fifth connecting plate portion extending upwardly and parallel to said pair of opposing plate portions, said fifth connecting plate portion comprising at least one third insertion hole;

said third application joint member comprising at least one end plate portion comprising an upper face, said at least one end plate portion being fixed to at least one of said top and bottom surfaces of said first through fourth connecting plate portions of said basic joint member and extending in a lateral direction; and sixth through ninth connecting plate portions comprising a second fitting protrusion having a substantially cross-figured lateral sectional shape, said sixth through ninth connecting plate portions being fixed to said upper face and extending upwardly parallel to said first to fourth connecting plate portions, respectively, and at least two of said sixth through ninth connecting plate portions comprising a pair of opposing plate portions including at least one fourth insertion hole.

2. The joint apparatus as set forth in claim 1, wherein two of said first through fourth connecting plate portions of said basic joint member comprise a single plate member integrally defining two connecting plate portions opposing each other, said single plate member comprising two sides surfaces; and two of said first through fourth connecting plate portions of said basic joint member comprising two connecting plate members opposing each other, each of said two connecting plate members comprising an end portion, one of said two connecting plate members being fixed at said end portion to one of said two side surfaces of said single plate member and the other of said two connecting plate members being fixed at said end portion to the other of said two side surfaces of said single plate member, said two connecting plate members extending orthogonally to respective side surfaces of said single plate member.

3. The joint apparatus as set forth in claim 1, wherein said at least one end plate portion of said first application joint member comprises an upper face, and said at least one end plate portion is connected to said bottom surfaces of said first through fourth connecting plate portions of said basic joint member at said upper face of said at least one end plate portion, and extends orthogonally to said first through fourth connecting plate portions.

4. The joint apparatus as set forth in claim 1, wherein at least one of said first through fourth connecting plate portions comprises an outer end portion including a bottom end face on said bottom surface, and said at least one end plate portion of said first application joint member is connected to said bottom end face and extends substantially orthogonally to said at least one of said first through fourth connecting plate portions.

5. The joint apparatus as set forth in claim 1, wherein at least one of said first through fourth connecting plate portions comprises an outer end portion including a top end face on said top surface, and said at least one end plate portion of said first application joint member includes a lower surface connected to said top end face and extending substantially orthogonally to said first through fourth connecting plate portions.

6. The joint apparatus as set forth in claim 1, wherein said at least one end plate portion of at least one of said first application joint member, said second application joint member and said third application joint member comprises at least one fifth insertion hole.

7. The joint apparatus as set forth in claim 1, wherein two of said sixth through ninth connecting plate portions of said second fitting protrusion comprise a single plate member integrally defining two connecting plate portions opposing each other, said single plate member comprising two sides surfaces; and two of said sixth through ninth connecting plate portions comprising two connecting plate members opposing each other, each of said two connecting plate members comprising an end portion, one of said two connecting plate members being fixed at said end portion to one of said two side surfaces of said single plate member and the other of said two connecting plate members being fixed at said end portion to the other of said two side surfaces of said single plate member, said two connecting plate members extending orthogonally to respective side surfaces of said single plate member.

8. The joint apparatus as set forth in claim 1, wherein said at least one end plate portion of said second application joint member and said third application joint member comprises a plurality of end plate portions.

9. The joint apparatus as set forth in claim 1, wherein said at least one application joint member comprises said first application joint member.

10. The joint apparatus as set forth in claim 1, wherein said at least one application joint member comprises said second application joint member.

11. The joint apparatus as set forth in claim 1, wherein said at least one application joint member comprises said third application joint member.

12. A building construction comprising:

at least one construction member comprising:

at least one longitudinal construction member and at least one lateral construction member;

said at least one longitudinal construction member comprising:

a first longitudinal construction member including an end portion and a first groove of a substantially cross-figured lateral sectional shape at said end portion of said first longitudinal construction member;

a second longitudinal construction member including an end portion and a second groove of a substantially straight line-figured lateral sectional shape at said end portion of second longitudinal construction member; and a third longitudinal construction member including an end portion and a third groove of a substantially cross-figured lateral sectional shape at said end portion of said third longitudinal construction member;

said at least one lateral construction member comprising an end portion and a fourth groove of a substantially straight line-figured lateral sectional shape at said end portion of said lateral construction member; and at least one joint apparatus for coupling said at least one construction member comprising:

a basic joint member comprising first through fourth connecting plate portions, with each of said first through fourth connecting plate portions comprising a top surface, a bottom surface and a end portion, said first through fourth connection plate portions defining a first fitting protrusion comprising a substantially cross-figured lateral sectional shape capable of fitting with said first groove of said first longitudinal construction member and with said fourth groove of said lateral construction member at at least one end portion of said first through fourth connecting plate portions;

at least two of said first through fourth connecting plate portions comprising a pair of opposing plate portions including at least one first insertion hole and at least one second insertion hole;

first means for coupling capable of penetrating said at least one first insertion hole for coupling a corresponding first through fourth connecting plate portion with said end portion of said first longitudinal construction member so that said first fitting protrusion is fitted with said corresponding first groove of said first longitudinal construction member;

second means for coupling capable of penetrating said at least one second insertion hole for coupling a corresponding first through fourth connecting plate portion with said end portion of said lateral construction member so that at least one of the end portions of said pair of opposing plate portions is fitted with said corresponding fourth groove of said lateral construction member;

at least one application joint member selected from the group consisting of a first application joint member, a second application joint member and a third application joint member;

said first application joint member comprising at least one end plate portion fixed to at least one of said top and bottom surfaces of said first through fourth connecting plate portions of said basic joint member and extending in a lateral direction so as to receive said end portion of one of said first to third longitudinal construction members;

said second application joint member comprising at least one end plate portion comprising an upper face, said at least one end plate portion being fixed to at least one of said top and bottom surfaces of said first through fourth connecting plate portions of said basic joint member and extending in a lateral direction; and a fifth connecting plate portion fixed to said upper face of said at least one end plate portion, said fifth connecting plate portion extending upwardly and parallel to said pair of opposing plate portions, said fifth connecting plate portion comprising at least one third insertion hole;

third means for coupling capable of penetrating said at least one third insertion hole for coupling said fifth connecting plate portion with said end portion of said second longitudinal construction member so that said fifth connecting plate portion is fitted with said corresponding second groove of said second longitudinal construction member;

said third application joint member comprising at least one end plate portion comprising an upper face, said at least one end plate portion being fixed to at least one of said top and bottom surfaces of said first through fourth connecting plate portions of said basic joint member and extending in a lateral direction; and sixth through ninth connecting plate portions comprising a second fitting protrusion having a substantially cross-figured lateral sectional shape, said sixth through ninth connecting plate portions being fixed to said upper face and extending upwardly parallel to said first to fourth connecting plate portions, respectively, and at least two of said sixth through ninth connecting plate portions comprising a pair of opposing plate portions including at least one fourth insertion hole;

fourth means for coupling capable of penetrating said at least one fourth insertion hole for coupling said end portion of said third longitudinal construction member so that said second fitting protrusion is fitted with said corresponding third groove of said third longitudinal construction member.

13. The building construction as set forth in claim 12, wherein two of said first through fourth connecting plate portions of said basic joint member comprise a single plate member integrally defining two connecting plate portions opposing each other, said single plate member comprising two sides surfaces; and two of said first through fourth connecting plate portions of said basic joint member comprising two connecting plate members opposing each other, each of said two connecting plate members comprising an end portion, one of said two plate members being fixed at said end portion to one of said two side surfaces of said single plate member and the other of said two plate members being fixed at said end portion to the other of said two side surfaces of said single plate member, said two plate members extending orthogonally to respective side surfaces of said single plate member.

14. The building construction as set forth in claim 12, wherein at least one of said first through fourth connecting plate portions comprises an outer end portion including a bottom end face on said bottom surface, and said at least one end plate portion of said first application joint member is connected to said bottom end face and extends substantially orthogonally to said at least one of said first through fourth connecting plate portions.

15. The building construction as set forth in claim 12, wherein said at least one end plate portion of at least one of said first application joint member, said second application joint member and said third application joint member comprises at least one fifth insertion hole capable of receiving at least one anchor bolt embedded in a foundation to couple said end plate portion with the foundation.

16. The building construction as set forth in claim 12, wherein two of said sixth through ninth connecting plate portions of said second fitting protrusion comprise a single plate member integrally defining two connecting plate portions opposing each other, said single plate member comprising two sides surfaces; and two of said sixth through ninth connecting plate portions comprising two connecting plate members opposing each other, each of said two connecting plate members comprising an end portion, one of said two connecting plate members being fixed at said end portion to one of said two side surfaces of said single plate member and the other of said two connecting plate members being fixed at said end portion to the other of said two side surfaces of said single plate member, said two connecting plate members extending orthogonally to respective side surfaces of said single plate member.

17. The building construction as set forth in claim 12, wherein at least one of said first means for coupling, said second means for coupling, said third means for coupling, said fourth means for coupling comprises bolt-nut assemblies.

18. The building construction as set forth in claim 12, wherein said at least one longitudinal construction member and said at least one lateral construction member comprise timber.

19. The building construction as set forth in claim 12, wherein said at least one end plate portion of said second application joint member and said third application joint member comprises a plurality of end plate portions.

20. The building construction as set forth in claim 12, wherein said at least one end plate portion of said first application joint member comprises an upper face, and said at least one end plate portion is connected to said bottom surfaces of said first through fourth connecting plate portions of said basic joint member at said upper face of said at least one end plate portion, and extends orthogonally to said first through fourth connecting plate portions.

21. The building construction as set forth in claim 20, wherein said end portion of said first longitudinal construction member comprises a lateral section, and said at least one end plate portion comprises a size substantially equivalent to said lateral section.

22. The building construction as set forth in claim 12, wherein at least one of said first through fourth connecting plate portions comprises an outer end portion including a top end face on said top surface, and said at least one end plate portion of said first application joint member includes a lower surface connected to said top end face and extending substantially orthogonally to said first through fourth connecting plate portions.

23. The building construction as set forth in claim 22, wherein said end portion of said first longitudinal construction member comprises a lateral section, and said at least one end plate portion comprises a size substantially equivalent to said lateral section.

* * * * *